US005487472A

United States Patent [19]

Satake et al.

[11] Patent Number: 5,487,472

[45] Date of Patent: Jan. 30, 1996

[54] COLOR SORTER FOR SORTING OUT MOLDY PULSE

[75] Inventors: Satoru Satake, Tokyo; Tadanobu Inaashi; Takafumi Ito, both of Hiroshima, all of Japan

[73] Assignee: Satake Corporation, Tokyo, Japan

[21] Appl. No.: 269,109

[22] Filed: Jun. 30, 1994

[30] Foreign Application Priority Data

Jun. 30, 1993 [JP] Japan ..... 5-183451

[51] Int. Cl.[6] ..... B07C 5/342; B07C 5/00

[52] U.S. Cl. ..... 209/581; 209/587; 209/588; 209/938; 250/226; 356/407; 356/425

[58] Field of Search ..... 209/555, 556, 209/559, 564, 576, 577, 580–582, 585, 587, 588, 639, 938; 250/223 R, 226; 356/407, 416, 419, 425

[56] References Cited

U.S. PATENT DOCUMENTS

| | | | |
|---|---|---|---|
| 3,004,664 | 10/1961 | Dreyfus | 209/588 X |
| 4,096,949 | 6/1978 | Hoover et al. | 209/588 X |
| 5,135,114 | 8/1992 | Satake et al. | 209/587 X |
| 5,158,181 | 10/1992 | Bailey | 209/581 X |
| 5,223,917 | 6/1993 | Richert | 356/407 |

FOREIGN PATENT DOCUMENTS

| | | | |
|---|---|---|---|
| 63-200878 | 8/1988 | Japan . | |
| 63-315179 | 12/1988 | Japan . | |
| 2165644 | 4/1986 | United Kingdom | 209/581 |

*Primary Examiner*—William E. Terrell
*Assistant Examiner*—Tuan Nguyen
*Attorney, Agent, or Firm*—Fish & Richardson

[57] ABSTRACT

A pulse color sorter which permits removal of internally and externally moldy pulse having afuratoxine as decomposition product is disclosed. The pulse color sorter comprises a first detector which provides a first and a second detection signal according to dispersed and transmitted light having two different wavelengths (for instance 700 and 1,100 nm) with different contents of information due to the separation of wavelengths, a second detector which provides a third detection signal according to reflected light, and a controller which calculates division of the first and second detection signals from the first detector, compares the resultant value calculated to a first predetermined threshold value while also compares the third signal from the second detector to a second threshold value, and outputs an eject signal if either of the compared signals is beyond the corresponding threshold value. According to the eject signal, corresponding defective pulse is forcibly ejected. Since the judgment as to moldy pulse is done on the basis of the division of the first and second detection signals, accurate judgment is obtainable irrespective of the sizes of individual pieces of pulse.

9 Claims, 5 Drawing Sheets

COLOR SORTER FOR SORTING OUT MOLDY PULSE

BACKGROUND OF THE INVENTION

1. Field of the Invention

This invention relates to color sorters and, more particularly, to a color sorter for sorting pulse such as peanuts.

2. Description of the Related Art

Japanese Patent Application Kokai-Publication No. Sho No. 63-200878 discloses a color sorter of bichromatic type for sorting pulse. In this color sorter, pulse passing a detecting position continuously is illuminated from a light source, and an optical system which is provided in three directions measures and photoelectrically converts the difference between light reflected from the pulse and light from a reference color member (a background). When the detected difference signal thus obtained exceeds a predetermined level (a threshold value), the corresponding pulse is judged as abnormal color defective pulse, such as unripe pulse, worm-eaten pulse, etc. and the same is ejected by an ejector.

Japanese Patent Application Kokai-Publication No. Sho 63-315179 also discloses a color sorter of the same bichromatic type wherein the sorting accuracy is enhanced. In this color sorter, detecting positions are provided at two positions, i.e., above and below an ejector. Pulse which has been judged at the upper detecting position as normal pulse and passed the ejector without being ejected, is measured once again at the lower detecting position to check whether proper sorting has been done in the upper detecting position. If it is found that the sorting is improper, the result is fed-back to a controller so as to adjust or reset the threshold value for the upper detecting position. Thus, the sorting accuracy is enhanced.

In the sorting of pulse, the foreign matter that has been contained in the material pulse, such as earth, stones, grass, etc., can be comparatively readily removed using a specific gravity sorter, a wind sorter, etc. Further, defective pulse such as unripe pulse and worm-eaten pulse can be practically sufficiently removed by the conventional color sorters of bichromatic type noted above, which is based on the light reflected from a surface of the pulse. However, it is theoretically impossible to sort out moldy pulse as a kind of defective pulse, particularly internally moldy pulse in which mold exists inside the pulse, with the conventional bichromatic color sorters based on the reflected light. Further, externally moldy pulse with mold externally produced thereon could be sorted out insufficiently with the conventional color sorters based on the reflected light.

Afuratoxine produced on moldy pulse is a poison produced from mold. It is a kind of mycotoxine and is thought to be a cancer-inducing substance. Its dealing, therefore, is now an important problem all over the world. To effectively detect and remove such moldy pulse in the sorting of pulse, is thus very important for avoiding the poisonous matter and ensure safety of the food.

SUMMARY OF THE INVENTION

It is, therefore, an object of the invention to overcome the problems existing in the conventional pulse color sorter and to provide an improved pulse color sorter, which permits not only the detection and removal of foreign matters and such abnormal color pulse as unripe pulse and worm-eaten pulse but also effective detection and removal of internally and externally moldy pulse.

According to one aspect of the invention, there is provided a pulse color sorter comprising:

a pulse feeder for continuously feeding pulse to be examined to a first and a second detecting position with a predetermined distance provided therebetween;

a first detector arranged at the first detecting position and including first illuminating means for illuminating the pulse passing the first detecting position, and first light-receiving means for receiving light of different wavelengths dispersed and transmitted through the pulse and generating a first and a second detection signal on the basis of light of the different wavelengths;

a second detector arranged at the second detecting position and including a second illuminating means for illuminating the pulse passing the second detecting position, a reference color means having a brightness control function, and a second light-receiving means opposing to the reference color means with the second detecting position intervened therebetween, for receiving light reflected by the pulse illuminated by the second illuminating means and light from the reference color means and generating a third detection signal on the basis of a difference between intensity of the light reflected by the pulse and intensity of the light from the reference color means;

a controller for calculating a ratio between the first and second detection signals generated by the first detector and judging the pulse as abnormal pulse, thereby generating an eject signal for ejecting the abnormal pulse, when a resultant ratio calculated is outside a first predetermined threshold range and/or the third detection signal generated from the second detector is outside a second predetermined threshold range; and an ejector connected to the controller and operable in response to the eject signal to eject the abnormal pulse to a flow-down path different from a flow-down path through which normal pulse is allowed to flow down.

The pulse under process, which is fed to the first detecting position by the pulse feeder, is checked component-wise as to whether it is moldy pulse or not on the basis of the measurement of dispersed and transmitted light by the first detector. Since the measurement is made on the basis of two different wavelengths, for instance 700 and 1,100 nm, having different contents of information as the values of the wavelengths are greatly different from each other, more accurate measurement is possible compared to the case of measurement based on a single wavelength. In addition, since the first and second detection signals based on the two different wavelengths are processed in the controller to calculate their ratio, the judgment is done irrespective of the sizes of the individual pieces of the pulse. The pulse which is judged as moldy pulse as a result of measurement by the first detector, is forcibly ejected from the path, through which normal pulse is allowed to flow down, at a position spaced apart a predetermined distance from the first detecting position, due to an operation of the ejector caused in response to the eject signal generated from the controller as a delayed signal corresponding to the predetermined distance.

The pulse under process that has passed the first detecting position reaches the second detecting position for color check as to whether its color is normal or abnormal on the basis of the measurement of the reflected light by the second detector. If the difference between the reflected light from the pulse under process and the light from the reference color plate is beyond a predetermined range of threshold value, the corresponding pulse is forcibly ejected from the path, along which normal pulse is allowed to flow down, at a position spaced apart a predetermined distance due to an operation of the ejector caused in response to the eject signal generated from the controller as a delayed signal corresponding to the predetermined distance.

As explained above, where the controller determines based on the detection signals from the first and/or second detectors that the corresponding pulse under process is defective, the defective pulse is forcibly sorted out from the normal pulse by the operation of the ejector. It is thus possible to efficiently remove not only the unripe pulse, worm-eaten pulse and like pulse but also moldy pulse which has been difficult to remove with the conventional sorter.

BRIEF DESCRIPTION OF THE DRAWINGS

The above and other objects, features and advantages of the present invention will be apparent from the following description of preferred embodiments of the invention explained with reference to the accompanying drawings, in which.

PREFERRED EMBODIMENT OF THE INVENTION

An embodiment of the invention will now be described with reference to the accompanying drawings.

Figure 1:
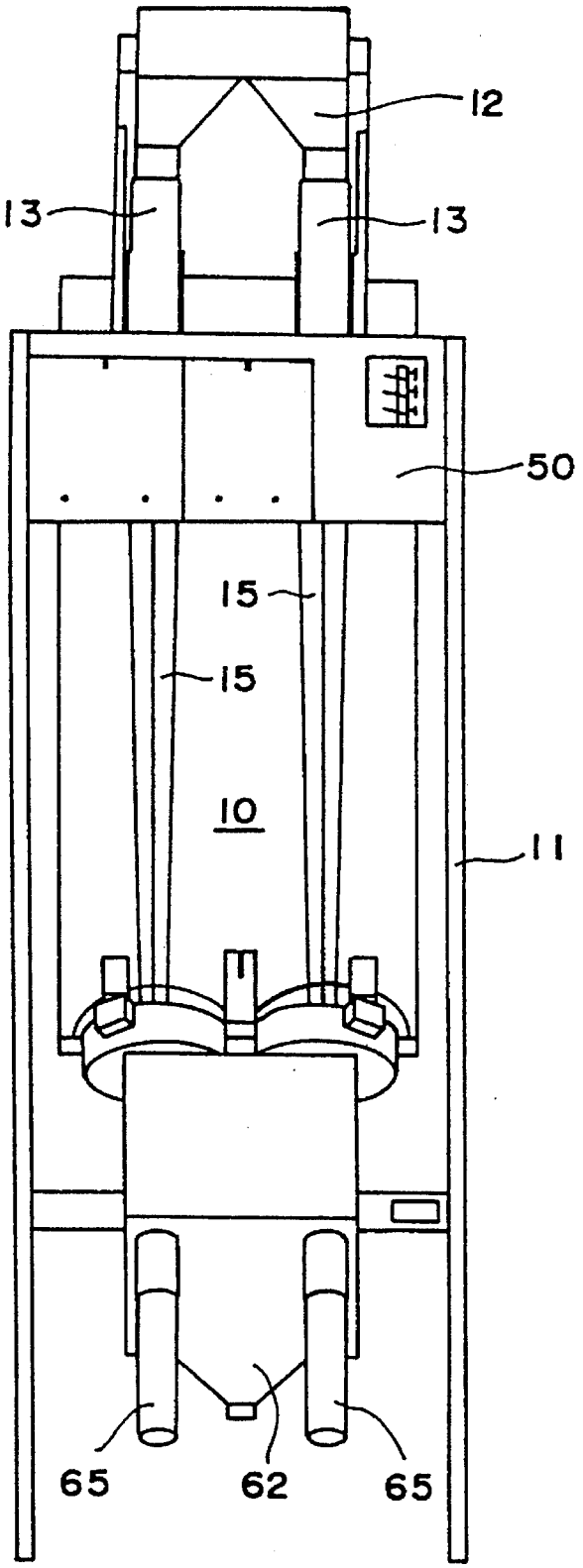
FIG. 1 is a schematic front view showing a pulse color sorter according to the invention.
Figure 2:
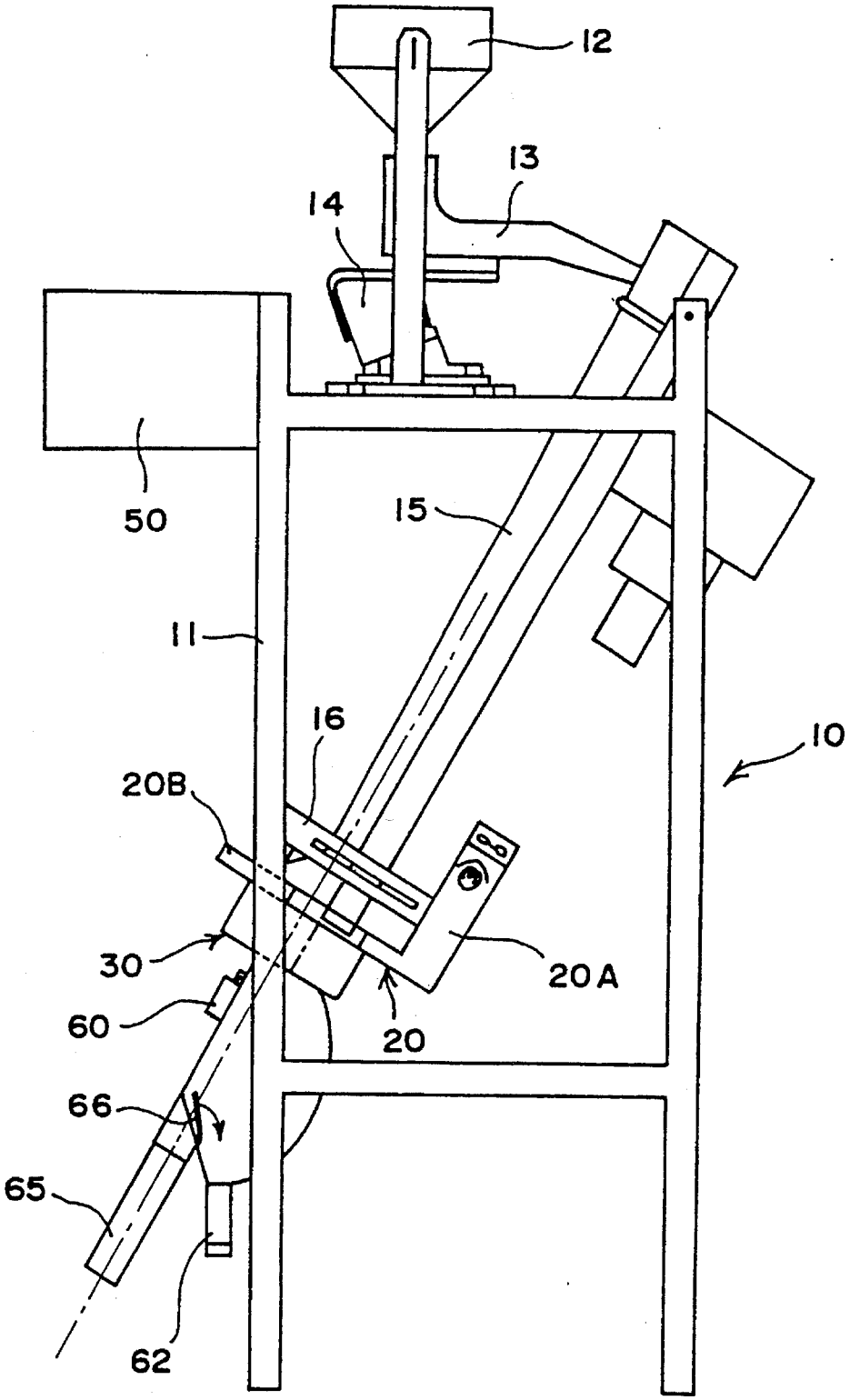
FIG. 2 is a schematic side view showing the same pulse color sorter.

FIG. 1 is a schematic front view showing a pulse color sorter according to the invention, and FIG. 2 is a schematic side view showing the same pulse color sorter. Referring to the figures, there is shown a pulse color sorter 10 having a frame 11. On the top of the frame 11, there are mounted a downwardly conical hopper 12 into which pulse to be examined is charged, a feeder 13 for feeding, under vibrations, pulse supplied naturally from the bottom of the hopper 12, and a vibrator 14 in contact with the underside of the feeders 13 for giving vibrations thereto. The vibrator 14 is secured to the frame 11 via a suitable vibration buffer member such as a leaf spring, a coil spring, or a rubber member, for preventing direct transmission of vibrations to the frame 11. Although not shown in the drawings, a shutter for controlling the supply of pulse from the hopper 12 to the feeder 13 is provided at the bottom of the hopper 12. As shown in FIG. 2, the feeder 13 has an outlet which is coupled with an upper end inlet of each of chutes 15, which are mounted in the frame 11 such that they extend obliquely from the rear upper end to the front lower end of the frame 11. The chutes 15 are each secured to the frame 11 with an appropriate stay 16. The chutes 15 each have a bottom having a V-shaped sectional profile, and thus pieces of pulse which have been fed at an adequate interval by the vibrating action of each feeder 13 are fed in a row in the chutes 15 to be discharged from the lower ends thereof substantially at a uniform initial speed toward a first and a second detecting position to be described later.

The hopper 12, feeders 13, vibrator 14 and chutes 15 noted above are main components of the pulse feeder.

Figure 3:
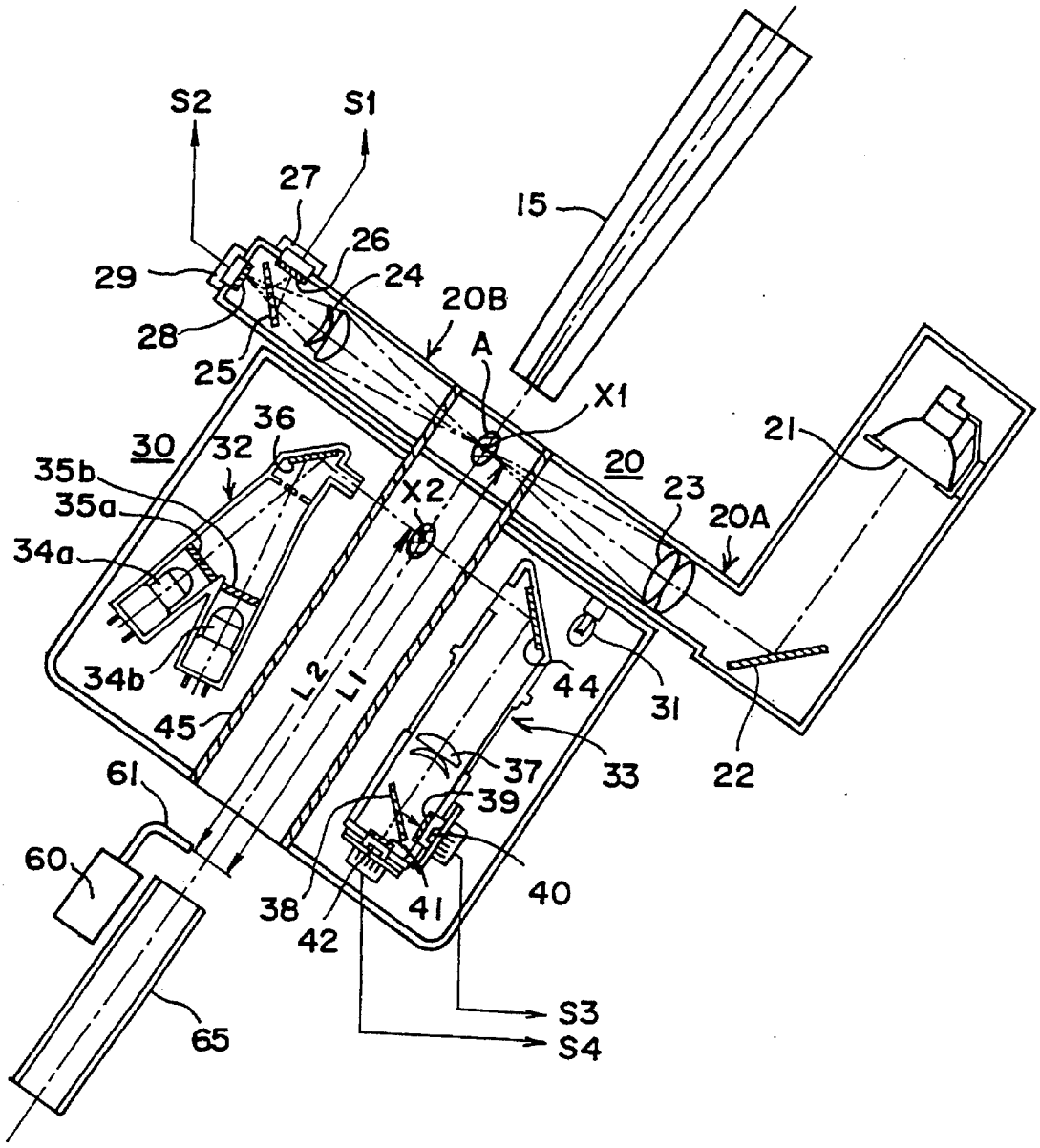
FIG. 3 is a fragmentary enlarged-scale sectional view showing the same pulse color sorter.

Now, reference is made to FIG. 3, in addition to FIGS. 1 and 2, which shows, in an enlarged-scale sectional view, the detectors and ejector as essential components of the pulse color sorter according to the invention. The pulse under process that is discharged from the lower end of each chute 15 passes a first detecting position X1 of a first detector 20 which measures dispersed and transmitted light from the pulse under process, and then a second detecting position X2 of a second detector 30 which measures reflected light from the pulse under process, along a predetermined flow-down orbit and at a predetermined flow-down speed. The first and second detectors 20 and 30 output detection signals to a controller 50. The controller 50 executes a check according to the detection signal from each detector as to whether the pulse under process is normal or defective. If it determines the pulse as a defective one, it outputs an eject signal to an air valve 60. According to the eject signal, high pressure air is jet from a jet nozzle 61 to forcibly guide the defective piece of pulse from the normal flow-down path to a recovery chute 62. The pulse under process, which has been determined as a normal one by the controller 50 based on the detection signals from the first and second detectors 20 and 30, is led directly to a discharge tube 65 which is provided along the flow-down orbit, without receiving high pressure air from the jet nozzle 61. Designated at 66 is a shutter which is held open during the normal sorting operation. The shutter 66 is provided for leading all the pulse to the recovery chute 62 when adjusting the machine, i.e., when making so called initial setting thereof, which is required when using the machine. The initial setting includes the setting of each threshold value in the controller and adjustment of brightness of lamps in the reference color plate.

Now, a detailed structure of the first and second detectors 20 and 30 will be described with reference to FIG. 3.

First, the specific structure of the first detector 20 will be described. The first detector 20 includes an illumination cylinder 20A accommodating therein a light source such as a halogen lamp and a detection cylinder 20B accommodating therein a plurality of detectors, the cylinders 20A and 20B being disposed on the opposite sides of the first detecting position X1. More specifically, as shown in an enlarged-scale sectional view of FIG. 3, the illumination cylinder 20A accommodates a halogen lamp 21 disposed adjacent one end, a converging lens 23 disposed adjacent the other end, and a mirror 22 disposed at a corner for 90 degree direction change. Light from the halogen lamp 21 is converged by the lens 23 to illuminate pulse A under process arriving at the first detecting position X1. Light dispersed in and transmitted through the pulse A under process is directed toward the detection cylinder 20B. The detection cylinder 20B accommodates therein the converging lens 24 disposed on the side of the first detecting position X1. Light converged by the lens 24 is divided by a half mirror 25 into two light beams which are directed in directions at an angle of 90° from each other. One of the light beams which has reached the half mirror 25 is incident on a low-pass optical filter 26 which selectively passes only a short wavelength region of light, for instance at 700 nm. A sensor 27 disposed behind the low-pass optical filter 26 detects the intensity of light and outputs a detection signal S1. The other light beam which has reached the half mirror 25 is incident on a high-pass optical filter 28 which selectively passes only a long wavelength region of light, for instance at 1,100 nm. A sensor 29 disposed behind the high-pass optical filter 28 detects the intensity of light and outputs a detection signal S2. The detection signals S1 and S2 from the sensors 27 and 29 have different contents of information due to the separation of their wavelengths from each other, and they are supplied to the controller 50 which will be described later in detail.

The wavelength of 700 nm which is the nominal wavelength of the low-pass optical filter 26, and the wavelength of 1,100 nm which is the nominal wavelength of the high-pass optical filter 28 are empirically obtained values of wavelength, which can provide the most pronounced difference when detecting afuratoxine in the near-infrared range. In the moldy pulse, oil is decomposed as mold grows. Consequently, fatty acid as the decomposition product increases, and eventually there is the decomposition product solely. Accordingly, the correlation between the oil decomposition factor and light transmittance (transmitted light being reduced with increase of the decomposition product) was examined to find out the wavelengths of 700 and 1,100 nm as effective wavelengths for the sorting.

Figure 4:
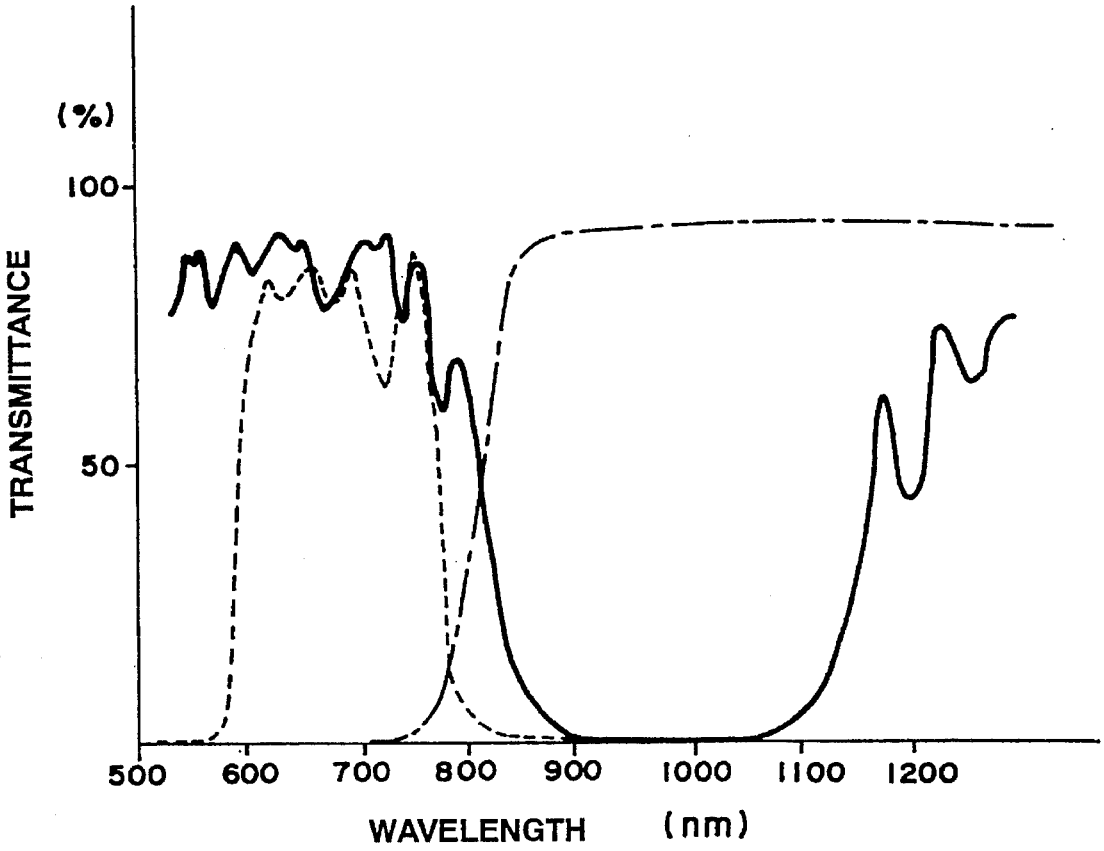
FIG. 4 is a graph showing typical characteristics of filters, particularly a dichroic mirror.

The half mirror 25 as light splitter means may be replaced by a dichroic mirror, which reflects all light on the long wavelength side of a certain wavelength and transmits all light on the short wavelength side. By using the dichroic mirror as the light splitter means, it is possible to more effectively sense even a very slight light intensity difference. A typical characteristic of the dichroic mirror is shown by the solid curve in FIG. 4. Typical characteristics of the usual low- and high-pass optical filters are shown by the dashed and phantom curves, respectively, in FIG. 4.

The pulse under process which has completed the examination based on the dispersed and transmitted light from the first detector 20, is allowed to fall down naturally to a second detecting position X2 of the second detector 30. The detailed structure of the second detector 30 will now be described. The second detector 30 basically comprises a halogen lamp 31, a reference color cylinder 32 and a detection cylinder 33 as a set. In an actual arrangement, three sets of these components are provided at an interval of 120° around the second detecting position X2 as the center for examining the entire circumference of pulse pieces under process. The reference color cylinder 32 accommodates therein adjustable lamps 34*a* and 34*b*, a red and a green filter 35*a* and 35*b*, and a white plate member 36 made of milky white glass or like material. The detection cylinder 33 accommodates therein at least a converging lens 37, spectral means comprising a half mirror 38 which divides light converged by the lens 37 into two directions, a red filter 39 provided for one of the two light beams from the spectral means, a sensor 40 for detecting the intensity of light passed through the red filter 39 and outputting a detection signal S3, a green filter 41 provided for the other light beam from the spectral means, and a sensor 42 for detecting the intensity of light passed through the green filter 41 and outputting a detection signal S4. Further, a mirror 44 may be provided in the detection cylinder 33, for 90-degree direction change of the optical axis of light from the reference color cylinder 32 and pulse under process in order to reduce the area occupied by the machine that is directed outward from the detecting position. Designated at 45 is a tubular transparent member which extends throughout the first and second detectors 30 and 40 to protect the machine from dust.

Like the first detector, a dichroic mirror may be used in place of the half mirror 38 as the spectral means used in the detection cylinder 33.

Figure 5:
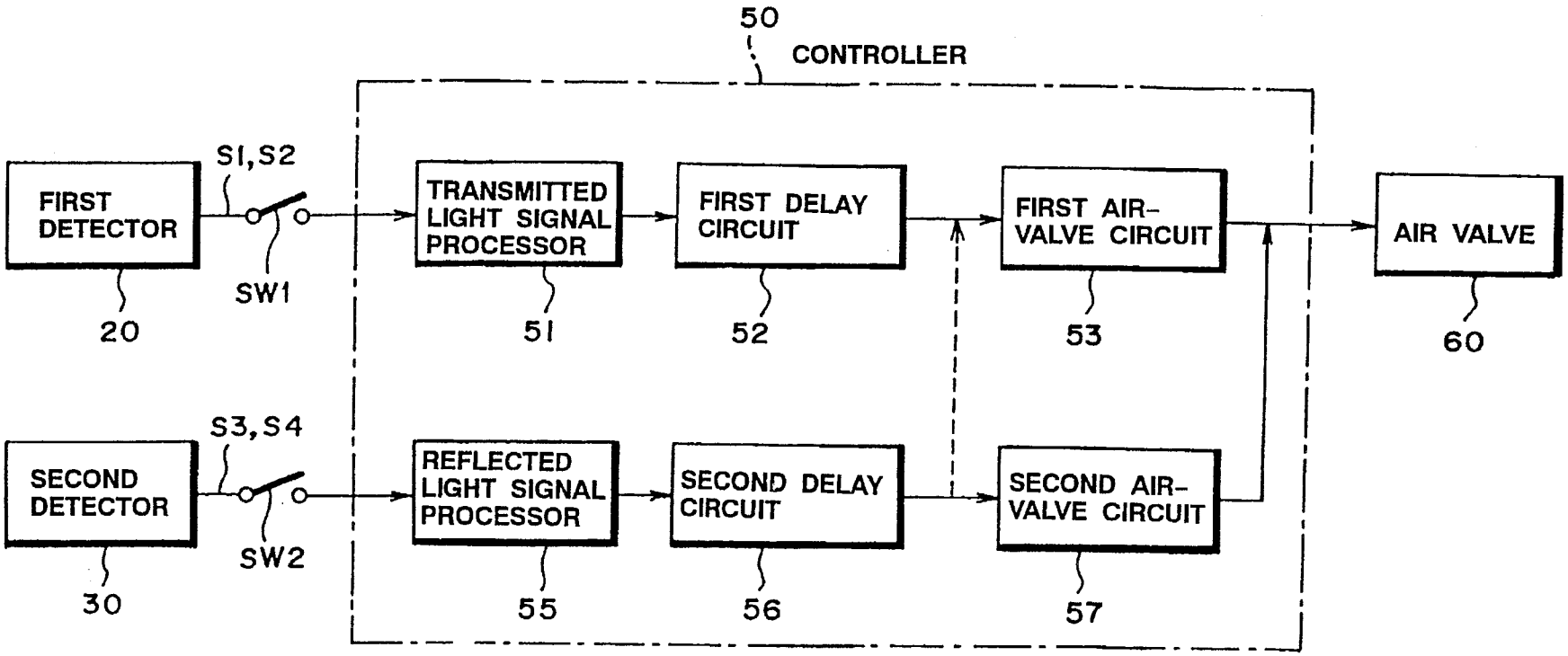
FIG. 5 is a block diagram showing a controller used in the pulse color sorter according to the invention.

The structure of the controller 50 will now be described with reference to FIG. 5. The controller 50 comprises a first series circuit which is for processing the detection signals S1 and S2 supplied from the first detector 20, the first series circuit including a transmitted light signal processing circuit 51, a first delay circuit 52 and a first air valve circuit 53, and a second series circuit which is arranged in parallel with the first series circuit and which is for processing the detection signals S3 and S4 from the second detector 30, the second series circuit including a reflected light signal processing circuit 55, a second delay circuit 56 and a second air valve circuit 57. The transmitted light signal processing circuit 51 executes division of the two signals S1 and S2 from the first detector 20, which are based on dispersed and transmitted light and having different contents of information due to the separation of the two wavelengths, and it also executes comparison of the resultant value with a predetermined threshold value. If the resultant value produced in the transmitted light signal processing circuit 51 is beyond the threshold value, the first delay circuit 52 provides a delay signal corresponding to the distance L1 from the first detecting position X1 to an air valve position (see FIG. 3). According to this delay signal, the first air valve circuit 53 provides an eject signal to the air valve 60. On the other hand, the reflected light signal processing circuit 55 executes comparison of the signals S3 and S4 from the second detector 30, which are based on the reflected light, to a predetermined threshold value. If the detection signals are beyond the threshold value, the second delay circuit 56 provides a delay signal corresponding to the distance L2 from the second detecting position X2 to the air valve position (see FIG. 3). According to this delay signal, the second air valve circuit 57 provides an ejection signal to the air valve 60. The air valve circuits may be replaced with a single air valve circuit 53, as shown by the dashed line, which commonly receives the outputs of the first and second delay circuits 52 and 56.

Switches SW1 and SW2 which are provided before the transmitted and reflected light signal processing circuits 51 and 55, respectively, are switches for selecting functions of the sorter. When the switches SW1 and SW2 are both closed, it is permitted not only to execute detection for moldy pulse on the basis of the dispersed and transmitted light but also to execute detection for unripe pulse, worm-eaten pulse, etc. on the basis of the reflected light. Of course, it is possible to execute detection of defective pulse on the basis of either transmitted or reflected light by closing either one of the two switches SW1 and SW2. Particularly, with only the switch SW1 closed, the moldy pulse content may be calculated by measuring the total quantity of pulse passing the first detecting position while obtaining the accumulated quantity of moldy pulse.

The illustrated embodiment is a two-channel color sorter as is obvious from FIG. 1. However, this number of channels is by no means limitative. In a multi-channel color sorter, a multiplexer may be used to use the controller commonly for the multiple channels on a time division basis. By so doing, it is possible to avoid the complication of the controller (i.e., the circuit thereof).

While the pulse color sorter according to the invention is for performing measurement on the basis of dispersed and transmitted light, it is of course effective for the measurement of either internally or externally moldy pulse.

As has been described in the foregoing, the detection of moldy pulse, which has hitherto been theoretically impossible by measurement based on the reflected light, is made possible by the measurement based on dispersed and transmitted light. In addition, since the moldy pulse is determined on the basis of a combination of two signals having different contents of information due to separation of the respective wavelengths in the near-infrared range, accurate determination is possible irrespective of the sizes of pulse pieces.

Further, by using the pulse color sorter according to the invention, it is possible to provide toxicity free pulse free to the consumer, thus greatly contributing to the food safety improvement.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A pulse color sorter comprising:

a pulse feeder for continuously feeding pulse to be examined to a first and a second detecting position with a predetermined distance provided therebetween;

a first detector arranged at said first detecting position and including first illuminating means for illuminating said pulse passing said first detecting position, and first light-receiving means for receiving light of different wavelengths dispersed and transmitted through said pulse and generating a first and a second detection signal on the basis of light of said different wavelengths, said first light-receiving means having spectral means for dividing said dispersed and transmitted light from said pulse into two different light beams directed in different directions, a short wavelength pass optical filter for selectively passing a particular short wavelength region of one of said two light beams from said spectral means, a first light receiver for detecting intensity of light passed through said short-wavelength pass optical filter, a long-wavelength pass optical filter for selectively passing a long wavelength region of the other one of said two light beams from said spectral means, and a second light receiver for detecting intensity of light passed through said long-wavelength pass optical filter;

a second detector arranged at said second detecting position and including a second illuminating means for illuminating said pulse passing said second detecting position, a reference color means having a brightness control function, and a second light-receiving means opposing said reference color means with said second detecting position intervened therebetween, for receiving light reflected by said pulse illuminated by said second illuminating means and light from said reference color means and generating a third detection signal on the basis of a difference between intensity of said light reflected by said pulse and intensity of said light from said reference color means;

a controller for calculating a ratio between said first and second detection signals generated by said first detector and judging said pulse as an abnormal pulse, thereby generating an eject signal for ejecting said abnormal pulse, when the resultant ratio calculated is outside a first predetermined threshold range or said third detection signal generated from said second detector is outside a second predetermined threshold range; and an ejector connected to said controller and operable in response to said eject signal to eject said abnormal pulse to a flow-down path different from a flow-down path through which said normal pulse is allowed to flow down.

2. The pulse color sorter according to claim 1, wherein said short wavelength region is of a wavelength of 700 nm and said long wavelength region is of a wavelength of 1,100 nm.

3. The pulse color sorter according to claim 1, wherein said spectral means is a half mirror.

4. The pulse color sorter according to claim 1, wherein said spectral means is a dichroic mirror.

5. The pulse color sorter according to claim 1, wherein said second detector includes a plurality of said second illuminating means, a plurality of said reference color means, and a plurality of said second light-receiving means, said plurality of second illuminating means, said plurality of reference color means and said plurality of second light-receiving means being disposed around said second detecting position.

6. The pulse color sorter according to claim 1, wherein said second light-receiving means in said second detector includes means for dividing reflected light from said pulse and light from said reference color means into a plurality of wavelength regions, and a plurality of light receivers each for receiving light of each of said plurality of wavelength regions.

7. The pulse color sorter according to claim 6, wherein said means for dividing light into a plurality of wavelength regions is a half mirror.

8. The pulse color sorter according to claim 6, wherein said means for dividing light into a plurality of wavelength regions is a dichroic mirror.

9. The pulse color sorter according to claim 1, which further comprises first switch means provided between said first detector and said controller, and second switch means provided between said second detector and said controller, said abnormal pulse being detected according to detection signal from said first and second detectors in a combination of "on"/"off" states of said first and second switch means.

* * * * *